US006345773B1

(12) United States Patent
Shanklin et al.

(10) Patent No.: US 6,345,773 B1
(45) Date of Patent: Feb. 12, 2002

(54) ASPIRATION-TYPE SPRAYER

(75) Inventors: Donald J. Shanklin, Fullerton; Ronald F. Englhard, Mission Viejo, both of CA (US); Stephen B. Leonard, Franksville; Kenneth H. Kloet, Kenosha, both of WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/601,302

(22) PCT Filed: Feb. 6, 1998

(86) PCT No.: PCT/US98/01576

§ 371 Date: Sep. 29, 2000

§ 102(e) Date: Sep. 29, 2000

(87) PCT Pub. No.: WO99/39835

PCT Pub. Date: Aug. 12, 1999

(51) Int. Cl.[7] ..... B05B 7/30

(52) U.S. Cl. ..... 239/318; 239/304; 239/310; 239/335; 239/344; 239/414; 239/581.1

(58) Field of Search ..... 239/310, 318, 239/304, 307, 335, 344, 413, 414, 434, 581.1, 10

(56) References Cited

U.S. PATENT DOCUMENTS

| | | | | | |
|---|---|---|---|---|---|
| 2,719,704 | A | * | 10/1955 | Anderson et al. | 239/318 |
| 2,724,583 | A | * | 11/1955 | Targosh et al. | 239/310 |
| 3,191,869 | A | * | 6/1965 | Gilmour | 239/318 |
| 3,610,535 | A | * | 10/1971 | Bradshaw | 239/310 |
| 4,901,923 | A | * | 2/1990 | McRoskey et al. | 239/310 |
| 5,007,588 | A | * | 4/1991 | Chow et al. | 239/318 |
| 5,213,265 | A | * | 5/1993 | Englhard et al. | 239/310 |

* cited by examiner

*Primary Examiner*—Steven J. Ganey

(57) ABSTRACT

A chemical aspiration sprayer head includes a carrier channel having an inlet, an outlet through which the carrier fluid exits, and an expansion chamber in between the inlet and outlet, a chemical supply channel in flow communication with the expansion chamber of the carrier channel through an aspiration opening, and a bleed line extending from the chemical supply channel between the aspiration opening and the liquid chemical, the bleed line connecting the chemical supply channel in flow communication to ambient air. A control valve assembly is seated in the sprayer head to simultaneously engage the carrier channel and the bleed line and with the carrier channel open, selectively open and close the bleed line to selectively permit ambient air to be drawn into the chemical supply channel in response to the aspiration flow produced by the flow of carrier fluid.

15 Claims, 5 Drawing Sheets

ASPIRATION-TYPE SPRAYER

TECHNICAL FIELD

The present invention relates generally to sprayers and more particularly to aspiration-type sprayers for dispensing chemicals in a carrier fluid.

BACKGROUND ART

Aspiration-type sprayers are commonly used to dispense liquid-based chemicals, such as washing detergents, fertilizers, or pesticides. The chemical, which is generally provided in a container in concentrated form, is diluted and propelled by a carrier fluid. In a common arrangement, the carrier fluid is water, and the sprayer is coupled to a garden hose. Water from the hose enters the sprayer through an inlet and flows through an expansion or mixing chamber and out through an outlet. The expansion chamber is configured so that the flow of water creates a pressure drop (venturi effect), which draws the chemical from the container into the expansion chamber, where it mixes with the stream of water. The amount of chemical drawn into the stream of water varies with the amount of pressure drop generated within the expansion chamber and by the size of the passage into the expansion chamber through which the chemical is drawn.

One example of an aspiration-type sprayer is shown in U.S. Pat. No. 5,213,265 (the '265 patent), issued to two of the inventors of the present invention, for a "Single Valve Aspiration Type Sprayer", and is incorporated herein by reference. The sprayer shown in the '265 patent operates by the above-described principle, and includes a rotatable valve that sits in, and selectively opens and closes, both a carrier fluid passageway and a chemical aspiration passageway. The aspiration passageway connects the contents of the container with an expansion chamber. The sprayer of the '265 patent provides for two modes of operation—"on" (wherein the valve is positioned to open the carrier fluid passageway and the chemical aspiration passageway) and "off" (wherein the valve is positioned to close the carrier fluid passageway and the chemical aspiration passageway). This arrangement is quite suitable for spraying chemicals. However, it would be beneficial to provide for a mode of operation in which the carrier fluid could be sprayed with no (or only trace amounts) of the chemical mixed therewith.

U.S. Pat. No. 5,007,588, issued to Chow et al., for an "Aspiration-Type Sprayer" shows another sprayer, which includes a nozzle that directs water to flow over an aspiration opening at the top of a passageway through which the contents of a connected container can be drawn. A bleed passage extends from the passageway below the aspiration opening. Opening and closing the bleed passage, as by the operator putting his finger thereover, permits the contents of the container to be selectively drawn through the passageway by the suction created by the flow of water over the aspiration opening. Although the sprayer disclosed in the Chow et al. patent can spray water without mixing the container contents therewith, a separate mechanism is required to control the flow of water through the sprayer, complicating operation of the sprayer. Further, the user must continuously, manually hold closed the bleed hole in order to aspirate the container contents.

U.S. Pat. No. 3,191,869, issued to Gilmour, for a "Spraying Device Having Restricted Orifice and Expansion Chamber Construction" discloses another sprayer, which includes a valve mechanism for varying the amount of chemical drawn into a water stream. A passage is formed in an upper portion of the sprayer, connecting a mixing chamber with ambient environment. The passage is selectively restricted by a disk having a plurality of different-sized openings. The disk can be rotated to allow varying amounts of air to pass through the passage and into the mixing chamber, thereby varying the amount of chemical that is drawn into the water stream. Although the sprayer disclosed in the Gilmour patent permits a variable aspiration rate, a separate valve is required to control the flow of water through the sprayer, thus complicating the manufacture and operation of the sprayer.

Another method of varying the aspiration rate is disclosed in U.S. Pat. No. 4,901,923, issued to McRoskey, et al. for "Variable Dilution Ratio Hose-End Aspirator Sprayer." In the sprayer of this patent, a passage between the container and the mixing chamber is selectively restricted by a disk having a plurality of different-sized openings. The disk can be rotated to vary the size of the orifice through which the chemical must pass to reach the mixing chamber. As with the sprayer of the Gilmour patent, however, a separate valve is required for controlling the flow of water through the sprayer.

Thus, there is a need in the art for an aspiration-type sprayer in which a single control valve can control the flow of carrier fluid and aspiration of chemical therein.

There is a further need in the art for an aspiration-type sprayer in which a single control valve can control the flow of carrier fluid and the mixing of varying quantities of chemical into the carrier fluid.

There is yet another need in the art for an aspiration-type sprayer which includes a mechanism for aspiration control without need for continuous, manual user action.

DISCLOSURE OF THE INVENTION

The present invention addresses the foregoing needs in the art by providing an aspiration type sprayer in which a bleed line, extending from a chemical supply tube, and a carrier channel can both be controlled by a single control valve.

According to one aspect of our invention an aspiration-type sprayer for use with a liquid chemical includes a sprayer head and a control valve assembly. The sprayer head includes (i) a carrier channel having an inlet for receiving a pressurized carrier fluid, an outlet through which the carrier fluid exits, and an expansion chamber in between the inlet and outlet, (ii) a chemical supply channel in flow communication with the expansion chamber of the carrier channel through an aspiration opening, so that a flow of carrier fluid through the carrier channel produces an aspiration flow from the chemical supply channel into the expansion chamber through the aspiration opening, the chemical supply channel having a free end for submersion in the liquid chemical, and (iii) a bleed line extending from the chemical supply channel between the aspiration opening and the liquid chemical, the bleed line connecting the chemical supply channel in flow communication to ambient air. The control valve assembly is seated in the sprayer head to simultaneously engage the carrier channel and the bleed line, the control valve assembly being movable relative to the sprayer head to (i) selectively open and close the carrier channel to selectively permit the carrier fluid to flow therethrough, and (ii) with the carrier channel open, selectively open and close the bleed line to selectively permit ambient air to be drawn into the chemical supply channel in response to the aspiration flow produced by the flow of carrier fluid.

According to another aspect of our invention, the bleed line is dimensioned so that, when pressurized carrier fluid is supplied to the inlet and the control valve assembly is positioned to open both the carrier channel and the bleed line, sufficient ambient air is drawn through the bleed line into the chemical supply channel so that no liquid chemical is drawn by the aspiration flow into the expansion chamber.

According to still another aspect of our invention, the bleed line is dimensioned so that, when pressurized carrier fluid is supplied to the inlet and the control valve assembly is positioned to open both the carrier channel and the bleed line, ambient air is drawn through the bleed line into the chemical supply channel at a flow rate sufficient to partially counterbalance the aspiration flow, so that liquid chemical is drawn into the expansion chamber in smaller proportions than when carrier fluid is supplied to the inlet and the control valve is positioned to open the carrier channel and close the bleed line.

In yet another aspect of our invention, the liquid chemical comprises two batches of liquid chemical, the chemical supply channel comprises (i) a first chemical passage in flow communication with the expansion chamber and having a free end for submersion in one of the batches of liquid chemical and (ii) a second chemical passage in flow communication with the expansion chamber and having a free end for submersion in the other of the batches of liquid chemical, the bleed line comprises a first bleed passage and a second bleed passage, each of the bleed passages connecting a corresponding one of the chemical passages in flow communication with ambient air, and the control valve assembly, with the carrier channel open, selectively opens and closes each of the bleed passages.

These and other objects, features, and advantages of the present invention will be more evident from the following description and drawings in which like reference numerals relate like elements throughout.

MODES FOR CARRYING OUT THE INVENTION

Figure 1:
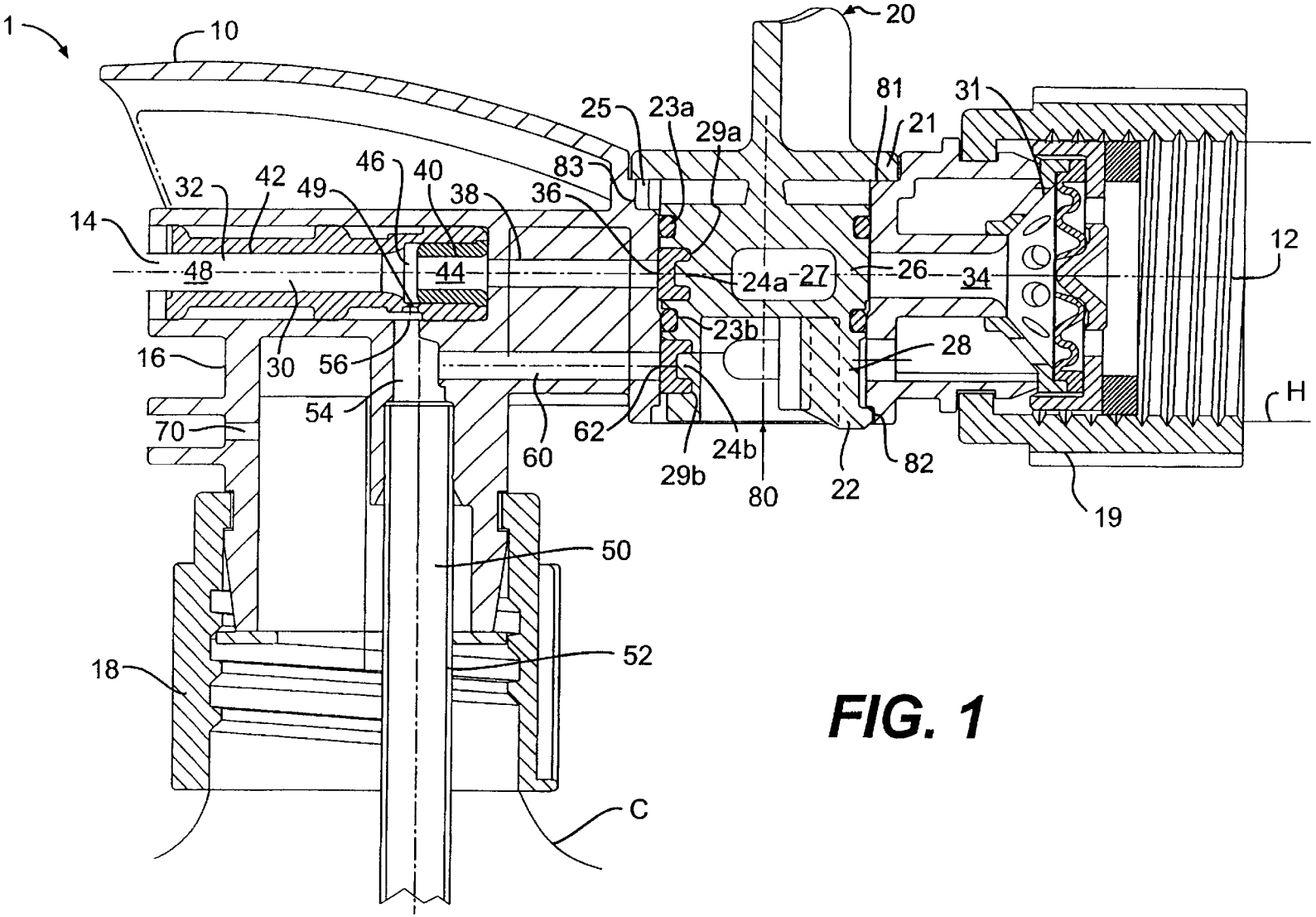
FIG. 1 is an elevational cross section of an aspiration-type sprayer according to an embodiment of the present invention.
Figure 2A:
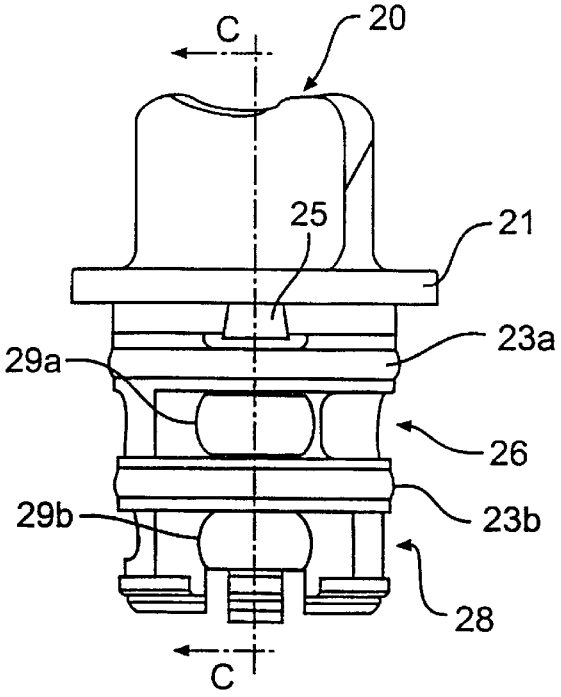
FIG. 2A is an elevational view of a control valve of the sprayer illustrated in FIG. 1.
Figure 2B:
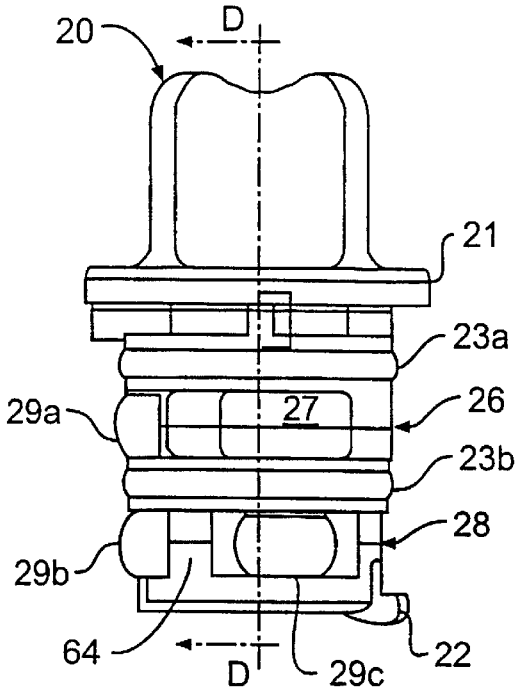
FIG. 2B is an elevational view of the control valve shown in FIG. 2A, rotated 90°.
Figure 2C:
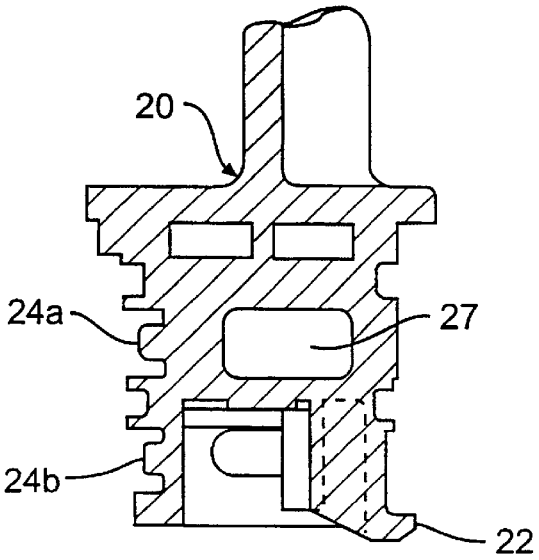
FIG. 2C is a cross section taken along the line C—C in FIG. 2A.
Figure 2D:
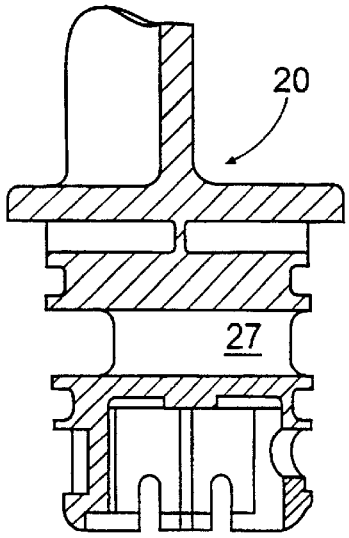
FIG. 2D is a cross section taken along the line D—D in FIG. 2B.

FIGS. 1 and 2A–2D show a preferred embodiment of an aspiration-type sprayer 1 of the present invention, two major components of which are a sprayer head 10 and a control valve 20. The sprayer head 10 is connectable to both a chemical source and a carrier fluid source. Usually, the chemical source will be a container C with soap, fertilizer, pesticides, or the like contained therein, and the carrier fluid source will be a water hose. For purposes of illustration, this embodiment of the aspiration-type sprayer 1 will often be described for use in a washing application in which the carrier fluid is water and the chemical is liquid detergent or surfactant. However, the sprayer could easily be adapted for use with other carrier fluids and chemicals.

In general, the sprayer head 10 includes a carrier inlet 12 and outlet 14. Between the inlet 12 and outlet 14 is a carrier channel 30 which includes an expansion chamber 32. A chemical supply channel 50 depends from the expansion chamber 32, and has a free end for submersion in the chemical. A bleed line 60 extends from the chemical supply channel 50. A bore 80 intersects both the carrier channel 30 and the bleed line 60. The control valve 20 sits in the bore 80 of the sprayer head 10. The valve 20 is moveable to selectively open and close the carrier channel 30 and the bleed line 60. A vent 70 exposes the mouth of the container C to the outside of the sprayer head 10.

The sprayer head 10 is preferably formed of a polypropylene copolymer. This material is chosen because, compared to other plastics such as polypropylene homopolymer, polypropylene copolymer is soft and pliable, facilitating assembly of the sprayer. However, almost any plastic, such as polyethylene, acetal, or the like, would be suitable for these purposes.

The carrier channel 30 includes an input chamber 31 at the inlet 12. A conventional threaded hose nut 19, with the accompanying hardware, is snap fit onto the end of the sprayer head 10 for coupling with a water hose H. The input chamber is tapered downstream and feeds into an upstream carrier passage 34. The upstream carrier passage 34 empties into the upstream side of the bore 80, which is generally cylindrical in shape. In the valve bore 80, approximately opposite the upstream carrier passage 34, is an inlet 36 to a downstream carrier passage 38. The downstream carrier passage 38 in turn empties into the expansion chamber 32. At the downstream end of the expansion chamber 32 is the outlet 14 to the sprayer head 10. Press fit through the outlet into the expansion chamber 32 is conventional sprayer metering jet hardware. Many commercially available metering jets can be used, and those skilled in the art will recognize that the hardware selected will aid in controlling the spray pattern and aspiration rate of the sprayer 1.

In the illustrated embodiment, by way of example, the metering jet hardware includes a metering jet insert 40 and a metering jet cartridge 42. The insert 40 and cartridge 42 are separately molded and fit together to facilitate production. The insert and cartridge are dimensioned to fit snugly within the expansion chamber 32, with the insert 40 upstream of the cartridge 42. The downstream carrier passage 38 empties into the metering jet insert 40, which has a cylindrical bore 44 therethrough with a flared upstream end, and an approximately 2.6 mm diameter. The downstream end of the generally cylindrical outer surface of the insert 40 is tapered and rounded. The metering jet cartridge 42 has a mouth dimensioned to receive the downstream end of the jet insert 40. The insert 40 empties into a cylindrical chamber 46 in the upstream end of the cartridge 42. This chamber 46 has a diameter of approximately 5.6 mm. The chamber 46 steps down in diameter and then tapers at its downstream end into a cylindrical passage 48 having a diameter of approximately 3.0 mm. Slightly before the downward step in diameter in the chamber 46, an aspiration opening 49, approximately 0.5 mm in diameter, extends down through the wall of the metering jet cartridge 42. The aspiration opening 49 is formed through the base of a depression in the outer surface of the cartridge 42.

As mentioned, the chemical supply channel 50 depends from the expansion chamber 32. At the upper end of the chemical supply channel 50 is a neck 54, at the top of which is an opening 56 into the expansion chamber 32. This opening 56 is considerably larger than and mates with the aspiration opening 49 in the metering jet. At the lower end of the channel 50 is a dip tube 52 for submersion in the chemical. In this embodiment, the neck 54 is integrally molded with the sprayer head 10, and the dip tube 52 is separately formed and press fit into the neck 54.

A conventional, threaded container nut 18, snap fit onto a skirt 16 which depends from the head, permits attachment to the chemical container. A vent 70 through the skirt 16 permits ambient air into the container, avoiding the creation of a vacuum in the chamber, which would undermine the aspiration process. This vent 70 could alternately be provided as an integral feature of the container.

The bleed line 60, which will be discussed in more detail below, extends between the chemical supply channel 50 and the bore 80. An inlet 62 to the bleed line 60 is aligned longitudinally on the wall of the bore 80 with the inlet 36 to the downstream carrier passage 38.

The control valve 20 of the illustrated embodiment is also preferably formed of a polypropylene copolymer, but could be formed of any of the alternate materials discussed above in connection with the sprayer head 10. The control valve 20 has a generally cylindrical overall shape and is longitudinally segregated by a pair of O-rings 23*a*, 23*b*, which are seated in circumferential grooves on the outer surface of the control valve 20. The O-rings are preferably formed of rubber or the like to provide a tight seal against the inside of the bore 80. During assembly, the valve 20 is inserted longitudinally into the bore 80 from the top until a top flange 21 contacts a peripheral seat 81 at the top of the bore 80. The valve 20 is held in the proper longitudinal position in the bore 80 by a pawl 22, which snap fits into another peripheral seat 82 at the bottom of the bore 80. Once seated, the control valve 20 can rotate freely on its longitudinal axis within a range of motion determined by the circumferential length of a groove 83 at the base of the top peripheral seat 81. A projection 25 on the underside of the top flange 21 sits in the groove 83 and prevents the valve 20 from rotating beyond its bounds. Of course, the valve 20 can be configured to move differently. For example, the valve 20 can be configured to rotate on an axis more or less parallel to the flow of carrier fluid, as opposed to rotating generally perpendicular, or to slide longitudinally rather than rotate within the bore 80. Any of a number of conventional valve motion limiters can be used as well.

Two primary operational sections of the valve 20 are the carrier control section 26, between the O-rings 23*a*, 23*b*, and the bleed control section 28, below the lower O-ring 23*b*. The carrier control section 26 is sealed between the O-rings 23*a*, 23*b*. A carrier duct 27 passes completely through the carrier control section 26. To one side of the carrier duct 27 is a stopper pad 29*a*. The stopper pad 29*a* sits in a depression and, when the control valve 20 is in the bore 80, fits tightly against the inside of the bore 80. The stopper pad is preferably formed of a suitable silicon, rubber or plastic which will deform slightly when compressed in the bore to provide a tight seal. Thermoplastic elastomers ("TPE's"), such as Kraton™ TPE, available from Shell Oil Company of Houston, Tex., have proven to be suitable. The stopper pad should have an arcuate outer surface to facilitate a tight fit with the inside of the bore. A boss 24*a* at the bottom of the depression mates with a receiving hole on the underside of the stopper pad 29*a*, preventing the stopper pad 29*a* from sliding circumferentially with respect to the control valve 20.

In operation, the control valve 20 is rotated to selectively position either the carrier duct 27 or the stopper pad 29*a* in the path of the carrier channel 30. When the control valve 20 is positioned so that the carrier duct 27 of the carrier control section 26 is aligned with the upstream and downstream carrier passages 34, 38 of the sprayer head 10, carrier fluid can flow freely through the carrier channel 30. When the control valve 20 is positioned so that the stopper pad 29*a* of the carrier control section 26 is aligned with the inlet 36 to the downstream carrier passage 38, the flow of carrier fluid is blocked.

The bleed control section 28 of the control valve 20 includes a pair of stopper pads 29*b*, 29*c*, which, like the stopper pad 29*a* of the carrier control section 26, are situated in depressions on the surface of the control valve. These stopper pads 29*b*, 29*c* also fit tightly against the inside of the bore 80 when the control valve 20 is in the bore. As with the carrier control section stopper pad 29*a*, a boss 24*b*, 24*c*, respectively, at the bottom of each depression mates with a receiving hole on the underside of each stopper pad 29*b*, 29*c* to prevent circumferential slippage. The stopper pads 29*b*, 29*c* of the bleed control section 28 are circumferentially spaced, with a gap 64 separating them. When the control valve 20 is positioned so that this gap 64 between the stopper pads 29*b*, 29*c* is aligned with the inlet 62 to the bleed line 60, the chemical supply channel 50 is in communication with the ambient air through the bleed line 60. The effect of this will be discussed below. On the other hand, when either of the stopper pads 29*b*, 29*c* of the bleed control section 28 is aligned with the inlet 62 to the bleed line 60, the bleed line 60 will be closed. Thus, any aspiration flow through the aspiration opening, caused by the venturi effect of the flow of carrier fluid in the expansion chamber 32, will in turn draw the chemical through the chemical supply channel 50 into the expansion chamber 32.

In the illustrated embodiment, the control valve 20 has an approximately 90° range of rotation, representing three operational settings. The stopper pad 29*a* of the carrier control section 26 and one of the stopper pads 29*b* of the bleed control section 28 are aligned longitudinally on the control valve 20, so as to be simultaneously engageable (in the first operational setting) with the inlets 36, 62 to the downstream carrier passage 38 and the bleed line 60, respectively. The mouth of the carrier duct 27 is elongated so that both the other stopper pad 29*c* and the gap 64 between the stopper pads 29*b*, 29*c* of the bleed control section 28 are longitudinally in line with part of the mouth of carrier duct 27. Thus, either the other stopper pad 29*c* or the gap 64 can be aligned with the bleed line 60 when the carrier duct 27 is aligned with the carrier channel 30. In the second operational setting, the carrier duct 27 is aligned with the carrier channel 30, and the gap 64 is aligned with bleed line inlet 62. In the third setting, the carrier duct remains aligned with the carrier channel, but the other stopper pad 29*c* of the bleed control section is aligned with the bleed line inlet 62. Therefore, the three operational settings are: (i) carrier channel 30 and bleed line 60 closed, (ii) carrier channel 30 and bleed line 60 open, and (iii) carrier channel 30 open and bleed line 60 closed.

The bleed line 60 of the embodiment shown in FIG. 1 is tubular and approximately 2.6 mm in diameter. This is more than sufficiently large to permit enough air to flow therethrough to counteract the aspiration flow through the aspiration opening 49, when the bleed line 60 is open. That is, rather than drawing the chemical from the container through the dip tube 52, the aspiration flow caused by the pressure drop in the expansion chamber 32 will simply cause ambient air to flow into the neck 54 of the chemical supply channel 50 through the bleed line 60. Because sufficient air can pass through the bleed line 60, the pressure at the top of the chemical supply channel 50 will remain essentially equal to the pressure on the top of the chemical in the container, and no chemical will flow through the chemical supply channel 50. Thus, when the bleed line 60 is open, any water that enters the sprayer head 10 at the inlet 12 will exit the sprayer head 10 at the outlet 14 without drawing any chemical with it.

Figure 3:
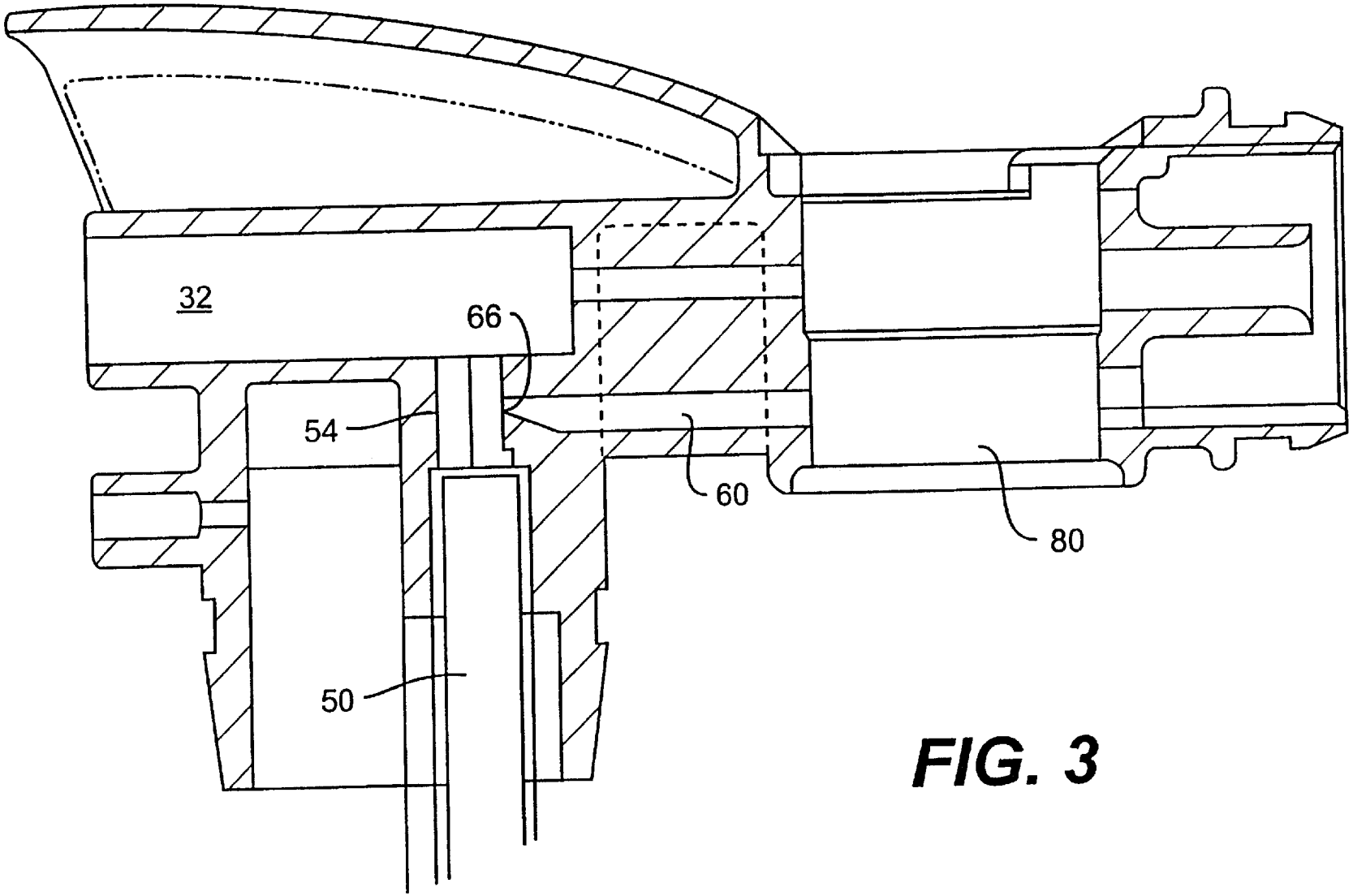
FIG. 3 is a schematic of a sprayer according to another embodiment of the present invention.

By reducing the size of the bleed line 60, it is possible to vary the above-noted affect. When the size of the bleed line 60 is reduced sufficiently, the flow of ambient air into the chemical supply channel 50 through the bleed line 60 can only partially compensate for the aspiration flow through the aspiration opening 49 due to the carrier flow through the expansion chamber 32. In response to the "uncompensated" aspiration flow, chemical will be drawn through the dip tube 52. In the embodiment illustrated in FIG. 3, the diameter of the bleed line 60 is reduced to approximately 0.5–1.0 mm at an integrally-molded constriction 66. With this configuration, with the bleed line 60 open, chemical will be drawn through the dip tube 52 at a rate comparable to the flow of air through the bleed line 60.

The illustrated constriction 66 is achieved by integrally molding a taper proximate the chemical supply channel 50, which narrows as the bleed line 60 approaches chemical supply channel 50. This is done to facilitate molding. However, the constriction can be located anywhere along the bleed line 60, and can be formed by tapering the bleed line 60 in the opposite direction or by any other shape. In fact, the bleed line 60 can have a uniform, small cross section.

In any event, by slightly varying the size of the constricted bleed line 60, the air/chemical ratio flowing through the neck 54 of the chemical supply channel 50 into the expansion chamber 32 can be controlled in a manner generally independent of the magnitude of the venturi effect caused by the carrier flow. Thus, the sprayer can be configured so that a select, reduced amount of the chemical is drawn into the expansion chamber 32 for mixing with the carrier when the bleed line 60 is open. For example, the expansion chamber 32, including the metering jet, of a hose end sprayer of an embodiment of the present invention can be selected to achieve a desired ratio of water to soap on the order of about 40:1 to about 80:1, when the bleed line 60 is closed. A constricted bleed line 60 can be used to create a "pre-wash" or "rinse" mode in which trace amounts of soap (for example, on the order of 1 part soap to approximately 300–600 parts water) are drawn into the flow of water, when the bleed line 60 is open.

The variations in the soap/air mixture (when the constricted bleed line 60 is open) will compound the variations in soap concentration that occur when the bleed line 60 is closed. For example, suppose a sprayer according to the present invention sprays a mixture with a chemical/carrier ratio of 50:1, with a variation of ±5:1, when the bleed line 60 is closed. If the bleed line 60 is constricted so that the sprayer sprays a mixture with a chemical/carrier ratio of 500:1 when the bleed line 60 is open, the variation in the latter mixture can be expected to be much greater than ±5:1, probably closer to ±20:1. This is because not only is the aspiration rate variable, but so is the chemical/air mixture, which in turn will be aspirated into the expansion chamber 32.

Figure 4A:
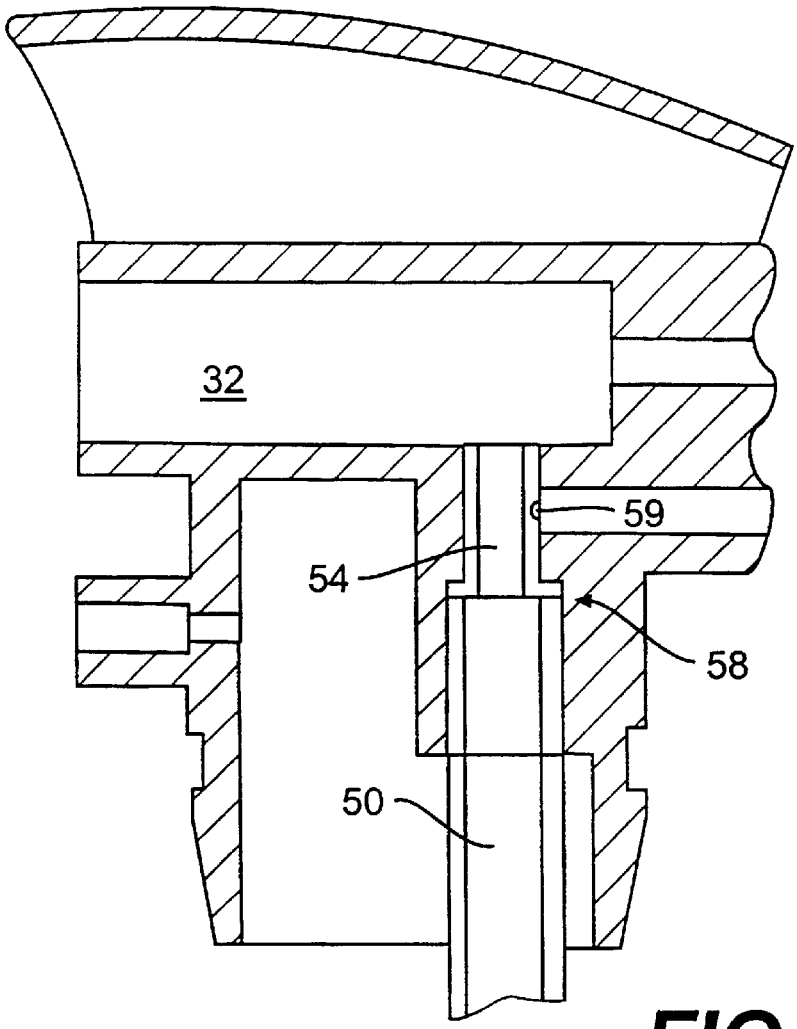
FIG. 4A is a schematic of a sprayer according to yet another embodiment of the present invention.
Figure 4B:
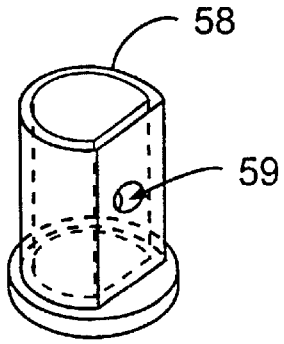
FIG. 4B is a perspective view of an insert of the sprayer illustrated in FIG. 4A.

In another embodiment, a separately molded insert 58 can be provided to create the desired reduction in size of the bleed line 60, as shown in FIGS. 4A and 4B. This separately molded insert fits into the neck 54 of the chemical supply channel 50. The insert 58 is hollow, with an open top and bottom, and is shaped to closely match the inside of the neck 54 of the chemical supply channel 50. A tapered hole 59 mates with the opening of the bleed line 60 to effectively constrict the opening of the bleed line 60. The insert 58 can be formed of polypropylene, acetal, polyethylene or any other suitable material. Once the insert 58 is fabricated, it can simply be press fit into the neck 54 of the chemical supply channel 50. The use of a separate insert 58 facilitates production, as compared to producing an integrally-molded bleed line 60 of such small dimensions. Using an insert, rather than attempting to produce a bleed line 60 of sufficiently small size, also allows more precise manufacturing, resulting in better control of mixing rates. Inserts can be produced with varying sizes of hole 59, increasing the flexibility to produce varying chemical/water ratios with the same design of sprayer head 10.

A similar effect can be achieved by reducing the size of the gap 64 between the stopper pads 29*b*, 29*c* in the bleed control section 28 of the valve 20. If the pads 29*b*, 29*c* are placed closely together, they will partially obstruct the inlet 62 to the bleed line 60 when the gap 64 between the pads 29*b*, 29*c* is aligned with the inlet 62.

In a similar manner, the bleed control section 28 of the valve 20 could be provided with three stopper pads, rather than two, circumferentially arranged so that two differently sized gaps between these pads are aligned with the carrier duct 27. A large gap, such as that shown in the embodiment illustrated in FIGS. 2A and 2B, can be provided between two of the stopper pads. When this large gap is aligned with the inlet to the bleed line 60, sufficient air can flow through the bleed line 60 so that no chemical is drawn through the chemical supply channel 50. The other gap can be smaller so that, when aligned with the inlet to the bleed line 60, it would still partially close the bleed line 60, resulting in trace amounts of chemical being drawn into the carrier flow in the manner discussed above.

Figure 5B:
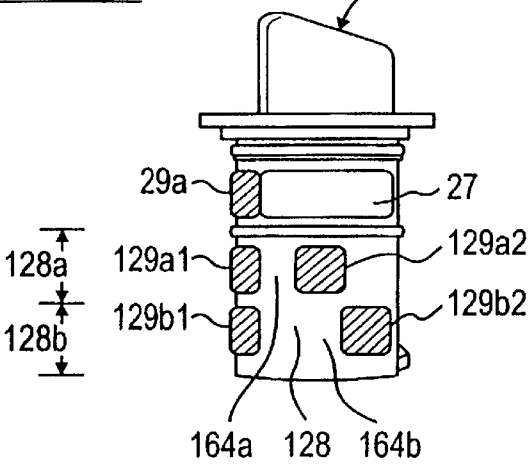
FIG. 5B is a perspective view of a control valve of the sprayer illustrated in FIG. 5A.
Figure 5A:
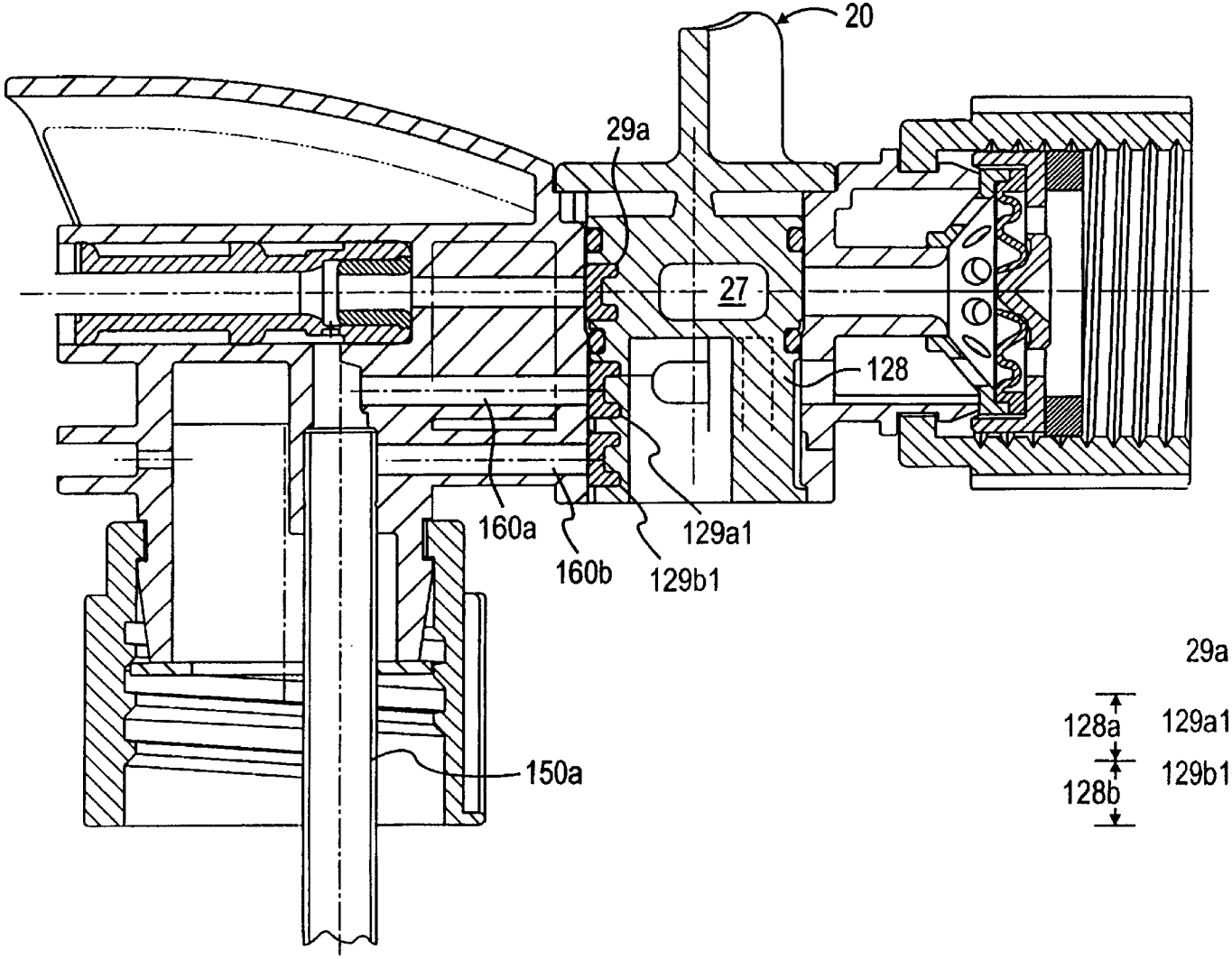
FIG. 5A is an elevational cross section of a sprayer according to a further embodiment of the present invention.

In yet another embodiment, shown in FIGS. 5A and 5B, the sprayer head 10 can be provided with apair of chemical supply channels 150*a*, 150*b* depending from the expansion chamber 32 for submersion into separate chemical containing chambers. One of the chemical supply channels 150*b* is not visible in this view because it is hidden behind the other. Two bleed lines 160*a*, 160*b* can be provided, one leading from each of the chemical supply channels 150*a*, 150*b* to the bore 80 in which the control valve 20 sits. The control valve 20 can be arranged to selectively close either bleed line 160*a* or 160*b* while opening the carrier channel 30, in which case chemical is drawn into the carrier flow from the corresponding one of the separate container chambers.

In the illustrated arrangement, the bleed lines 160*a*, 160*b* are shaped so that the inlets to the bleed lines are aligned and spaced longitudinally in the bore 80. The carrier control section 26 of the control valve 20 is essentially similar to that in the embodiment illustrated in FIGS. 1 and 2A–2D. The bleed control section 128 of the control valve 20, however, is longitudinally bifurcated into-separate levels 128*a*, 128*b* for engagement with these separate bleed lines 160*a*, 160*b*. Each of these levels 128*a*, 128*b* has two stopper pads 129*a*1, 129*a*2 and 129*b*1, 129*b*2, respectively. These stopper pads, like the stopper pad 29*a* of the carrier control section 26, are situated in depressions on the surface of the control valve 20 and fit tightly against the inside of the bore 80 when the control valve 20 is in the bore 80. Again, a boss at the bottom of each depression mates with a receiving hole on the underside of each stopper pad to prevent circumferential slippage. The stopper pads of each level 128*a*, 128*b* of the bleed control section 128 are circumferentially spaced, with a gap 164*a*, 164*b*, respectively, separating them. When the control valve 20 is positioned so that one of these gaps 164*a* or 164*b* between the stopper pads is aligned with the inlet to its corresponding bleed line 160*a* or 160*b*, the corresponding chemical supply channel 150*a* or 150*b* is in communication with the ambient air through the bleed line. On the other hand, when either of the stopper pads of a level 128*a* or 128*b* of the bleed control section 128 is aligned with the inlet to its corresponding bleed line 160*a* or 160*b*, that bleed line will be closed.

In this embodiment, like the first, the control valve 20 has an approximately 90° range of rotation. However, the additional bleed line and bleed control section level permit at least one additional operational mode. Thus, the sprayer 10 of this embodiment has four operational settings. The stopper pad 29*a* of the carrier control section 26 and one of the stopper pads 129*a*1, 129*b*1, respectively, of each level 128*a*, 128*b* of the bleed control section 128 are aligned longitudinally on the control valve 20, so as to be simultaneously engageable (in the first operational setting) with the inlets to the downstream carrier passage 38 and the bleed lines 160*a*, 160*b*, respectively.

The mouth of the carrier duct 27 is elongated so that the other stopper pads 129*a*2, 129*b*2, and the gaps 164*a*, 164*b* between the stopper pads of each level, respectively, of the bleed control section 128 are all longitudinally in line with part of the mouth of the carrier duct 27. Thus, on each level of the bleed control section 128, either the other stopper pad 129*a*2 or 129*b*2, or the gap 164*a* or 164*b*, respectively, can be aligned with the corresponding bleed line 60 when the carrier duct 27 is aligned with the carrier channel 30. The other stopper pads 129*a*2, 129*b*2 of the respective levels of the bleed control section 28, however, are not longitudinally aligned with one another. Thus, when the carrier duct 27 is aligned with the carrier channel 30, representing the second through fourth operational settings, either or neither, but not both, of the other stopper pads 129*a*2, 129*b*2 can be aligned with the inlet of its respective bleed line 160*a*, 160*b*. In the second operational setting, each of the gaps 164*a*, 164*b* is aligned with the inlets to its respective bleed line 160*a*, 160*b*. In the third setting, the other stopper pad 129*a*2 of the upper level 128*a* is aligned with its bleed line 160*a*, while the gap 164*b* of the lower level is still aligned with its bleed line 160*b*. In the fourth, the other stopper pad 129*a*2 of the upper level 128*a* is no longer aligned with its bleed line 160*a*, but the other stopper pad 129*b*2 of the lower level 128*b* is aligned with its bleed line 160*b*. Therefore, the four operational settings are: (i) carrier channel 30 and both bleed lines 160*a*, 160*b* closed, (ii) carrier channel 30 open and both bleed lines 160*a*, 160*b* open, (iii) carrier channel 30 and bottom bleed line 160*b* open, top bleed line 160*a* closed, and (iv) carrier channel 30 and top bleed line 160*a* open, bottom bleed line 160*b* closed.

As with the earlier embodiments, the valve 20 can be configured to move differently. For example, the valve 20 can be configured to rotate on a different axis, or to slide longitudinally rather than rotate, as will be appreciated by those skilled in the art.

The separate container chambers can be provided with different chemicals or different concentrations of the same chemical. For example, one chamber can be provided with a cleaning agent in a concentration that is suitable for spray washing. The other chamber can be provided with a rinsing agent in a concentration suitable for pre-washing and/or rinsing. The four operational settings would then correspond to "off," "water only," "cleaning agent and water mixed," and "rinsing agent and water mixed," respectively.

While the present invention has been described with respect to what is at present considered to be the preferred embodiments, it should be understood that the invention is not limited to the disclosed embodiments. To the contrary, the invention is intended to cover various modifications and equivalent arrangements, some of which are discussed above, included within the spirit and scope of the appended claims. Therefore, the scope of the following claims is intended to be accorded the broadest reasonable interpretation so as to encompass all such modifications and equivalent structures and functions.

INDUSTRIAL APPLICABILITY

A sprayer of the present invention is particulary applicable to hose-end sprayers. The sprayer can be used in conjunction with fertilizers, pesticides, and the like, but is best suited for use with soaps. The carrier fluid, in most cases tap water, can be used, with no soap or only trace amounts thereof, to soak and/or rinse the object to be washed. By simply turning the control valve, the sprayer can be turned off or set to spray water or a mixture of soap and water.

We claim:

1. An aspiration-type sprayer for use with a liquid chemical, the sprayer comprising:

(a) a sprayer head including (i) a carrier channel having an inlet for receiving a pressurized carrier fluid, an outlet through which the carrier fluid exits, and an expansion chamber in between the inlet and outlet, (ii) a chemical supply channel in flow communication with the expansion chamber of the carrier channel through an aspiration opening, so that a flow of carrier fluid through the carrier channel produces an aspiration flow from the chemical supply channel into the expansion chamber through the aspiration opening, the chemical supply channel having a free end for submersion in the liquid chemical, and (iii) a bleed line positioned upstream of the aspiration opening, the bleed line extending from the chemical supply channel between the aspiration opening and the liquid chemical, the bleed line connecting the chemical supply channel in flow communication to ambient air; and (b) a control valve assembly seated in the sprayer head to simultaneously engage the carrier channel and the bleed line, the control valve assembly being movable relative to the sprayer head to (i) selectively open and close the carrier channel to selectively permit the carrier fluid to flow therethrough, and (ii) with the carrier channel open, selectively open and close the bleed line to selectively permit ambient air to be drawn into the chemical supply channel in response to the aspiration flow produced by the flow of carrier fluid.

2. The sprayer of claim 1, wherein the sprayer head includes formed therein a bore intersecting the carrier channel and the bleed line, and wherein the control valve assembly is rotatably positioned within the bore.

3. The sprayer of claim 1, wherein the control valve assembly includes carrier channel closure means and bleed line closure means formed thereon and a carrier duct formed therethrough, the carrier channel closure means and the carrier duct being configured for selective engagement with the carrier channel to respectively close and open the carrier channel, and the bleed line closure means being configured for selective engagement with the bleed line to close the bleed line.

4. The sprayer of claim 3, wherein the control valve assembly is configured so that the bleed line closure means can be selectively engaged and disengaged with the bleed line when the carrier duct is engaged with the carrier channel in order to selectively open and close the bleed line when the carrier channel is open.

5. The sprayer of claim 3, wherein the sprayer head has formed therein a bore intersecting the carrier channel and the bleed line, and the control valve assembly is rotatably positioned within the bore, the control valve assembly being longitudinally divided into at least two sections, the sections including a carrier control section and a bleed control section, the carrier control section and the bleed control section being sealingly partitioned from one another, the carrier channel closure means and the carrier duct being located in the carrier control section, and the bleed line closure means being located in the bleed control section.

6. The sprayer of claim 1, wherein the bleed line is dimensioned so that, when pressurized carrier fluid is supplied to the inlet and the control valve assembly is positioned to open both the carrier channel and the bleed line, sufficient ambient air is drawn through the bleed line into the chemical supply channel so that no liquid chemical is drawn by the aspiration flow into the expansion chamber.

7. The sprayer of claim 1, wherein the bleed line is dimensioned so that, when pressurized carrier fluid is supplied to the inlet and the control valve assembly is positioned to open both the carrier channel and the bleed line, ambient air is drawn through the bleed line into the chemical supply channel at a flow rate sufficient to partially counterbalance the aspiration flow, so that liquid chemical is drawn into the expansion chamber in smaller proportions than when carrier fluid is supplied to the inlet and the control valve assembly is positioned to open the carrier channel and close the bleed line.

8. The sprayer of claim 1, wherein the control valve assembly is movable between a first position in which the carrier channel is closed so that no pressurized fluid flows through the carrier channel, a second position in which the carrier channel and the bleed line are open so that pressurized fluid can flow through the carrier channel and ambient air can flow through the bleed line into the chemical supply channel, and a third position in which the carrier channel is open and the bleed line is closed so that pressurized fluid can flow through the carrier channel and ambient air cannot flow through the bleed line into the chemical supply channel.

9. The sprayer of claim 1, wherein the liquid chemical is contained in a container, to which the sprayer head is connectable, and the sprayer head further includes a vent through which the ambient air can reach the interior of the container.

10. The sprayer of claim 1, wherein:

the liquid chemical comprises first and second batches of liquid chemical, the chemical supply channel comprises (i) a first chemical passage in flow communication with the expansion chamber and having a free end for submersion in the first of the batches of liquid chemical and (ii) a second chemical passage in flow communication with the expansion chamber and having a free end for submersion in the second of the batches of liquid chemical, the bleed line comprises a first bleed passage and a second bleed passage, each of the bleed passages connecting a corresponding one of the chemical passages in flow communication with ambient air, and the control valve assembly, with the carrier channel open, selectively opens and closes each of the bleed passages.

11. The sprayer of claim 10, wherein the control valve assembly includes carrier channel closure means, first bleed passage closure means, and second bleed passage closure means formed thereon and a carrier duct formed therethrough, the carrier channel closure means and the carrier duct being configured for selective engagement with the carrier channel to respectively close and open the carrier channel, the first bleed passage closure means being configured for selective engagement with the first bleed passage to close the first bleed passage, and the second bleed passage closure means being configured for selective engagement with the second bleed passage to close the second bleed passage.

12. The sprayer of claim 11, wherein the control valve assembly is configured so that, when the carrier duct is engaged with the carrier channel, the first bleed passage closure means can be selectively engaged and disengaged with the first bleed passage and the second bleed passage closure means can be selectively engaged and disengaged with the second bleed passage in order to selectively open and close the first and second bleed passages when the carrier channel is open.

13. The sprayer of claim 11, wherein the sprayer head has formed therein a bore intersecting the carrier channel and the first and second bleed passages, and the control valve assembly is rotatably positioned within the bore, the control valve assembly being longitudinally divided into a least two sections, the sections including a carrier control section and a bleed control section, the carrier control section and the bleed control section being sealingly partitioned from one another, the carrier channel closure means and the carrier duct being located in the carrier control section, and the first and second bleed passage closure means being located in the bleed control section.

14. The sprayer of claim 10, wherein the first and second bleed passages are dimensioned so that, when pressurized carrier fluid is supplied to the inlet and the control valve assembly is positioned to open both the carrier channel and one of the first and second bleed passages, sufficient ambient air is drawn through the one of the first and second bleed passages into a corresponding one of the chemical passages so that no liquid chemical is drawn through the corresponding one of the chemical passages by the aspiration flow into the expansion chamber.

15. The sprayer of claim 10, wherein the control valve assembly is movable between (i) a first position in which the carrier channel is closed so that no pressurized fluid flows through the carrier channel, (ii) a second position in which the carrier channel and both the first and second bleed passages are open so that pressurized fluid can flow through the carrier channel and ambient air can flow through the first and second bleed passages into the first and second chemical passages, (iii) a third position in which the carrier channel is open, the first bleed passage is closed, and the second bleed passage is open, so that pressurized fluid can flow through the carrier channel, ambient air cannot flow through the first bleed passage into the first chemical passage, and ambient air can flow through the second bleed passage into the second chemical passage, and (iv) a fourth position in which the carrier channel is open, the first bleed passage is open, and the second bleed passage is closed, so that pressurized fluid can flow through the carrier channel, ambient air can flow through the first bleed passage into the first chemical passage, and ambient air cannot flow through the second bleed passage into the second chemical passage.

* * * * *

UNITED STATES PATENT AND TRADEMARK OFFICE

CERTIFICATE OF CORRECTION

PATENT NO. : 6,345,773 B1 
DATED : February 12, 2002
INVENTOR(S) : Donald J. Shanklin, Ronald F. Englhard, Stephen B. Leonard and Kenneth H. Kloet It is certified that error appears in the above-identified patent and that said Letters Patent is hereby corrected as shown below:

Column 8,
Line 47, replace "apair" with -- a pair --.

Column 13,
Line 5, replace "a least" with -- at least --.

Signed and Sealed this

Fourth Day of June, 2002

*Attest:*

*Attesting Officer*

JAMES E. ROGAN
*Director of the United States Patent and Trademark Office*